US007091845B2

(12) United States Patent
Midland et al.

(10) Patent No.: US 7,091,845 B2
(45) Date of Patent: Aug. 15, 2006

(54) DATA ENTRY SYSTEMS WITH BIOMETRIC DEVICES FOR SECURITY ACCESS CONTROL

(75) Inventors: Lawrence W. Midland, Costa Mesa, CA (US); Douglas J. Morgan, Reno, NV (US)

(73) Assignee: Hirsch Electronics Corporation, Santa Ana, CA (US)

( * ) Notice: Subject to any disclaimer, the term of this patent is extended or adjusted under 35 U.S.C. 154(b) by 136 days.

(21) Appl. No.: 10/655,841

(22) Filed: Sep. 5, 2003

(65) Prior Publication Data

US 2005/0052278 A1 Mar. 10, 2005

(51) Int. Cl.
*G08B 23/00* (2006.01)

(52) U.S. Cl. ..... 340/500; 340/5.8; 340/5.81; 340/5.82; 340/5.85; 340/5.3; 340/5.33; 340/5.52; 340/5.1; 340/5.51; 340/5.83

(58) Field of Classification Search ..... 340/500, 340/5.8, 5.81, 5.82, 5.83, 5.85, 5.3, 5.33
See application file for complete search history.

(56) References Cited

U.S. PATENT DOCUMENTS

| | | | | |
|---|---|---|---|---|
| 4,333,090 A | | 6/1982 | Hirsch | |
| 4,479,112 A | | 10/1984 | Hirsch | |
| 5,206,782 A | | 4/1993 | Landmeier et al. | |
| 5,274,370 A | | 12/1993 | Morgan et al. | |
| 5,524,371 A | * | 6/1996 | Hunter | 40/450 |
| 5,668,929 A | | 9/1997 | Foster, Jr. | |
| 6,102,286 A | | 8/2000 | Hammond | |
| 6,330,674 B1 | * | 12/2001 | Angelo et al. | 713/186 |
| 6,657,538 B1 | * | 12/2003 | Ritter | 340/5.81 |
| 6,720,860 B1 | * | 4/2004 | Narayanaswami | 340/5.54 |
| 6,905,219 B1 | * | 6/2005 | Gaides | 362/23 |

FOREIGN PATENT DOCUMENTS

| | | |
|---|---|---|
| DE | 296 13 938 U1 | 10/1996 |
| EP | 0 147 837 A2 | 7/1985 |
| EP | 1 041 506 A2 | 10/2000 |
| EP | 1 041 506 A3 | 4/2004 |

* cited by examiner

*Primary Examiner*—Brian Zimmerman
*Assistant Examiner*—Vernal Brown
(74) *Attorney, Agent, or Firm*—Blakely Sokoloff Taylor & Zafman LLP

(57) ABSTRACT

A security system incorporating one or more biometric data recognition capabilities in a non-intrusive way to enhance the overall security provided by the system. The biometric recognition may be provided by incorporating one or more cameras in a keypad system wherein the key identifications are altered between uses, and wherein the viewing of the key identifications is sufficiently restricted so that an operator must be adequately aligned with the key identifications when operating the system that reliable biometric data may be automatically obtained during system operation without the need for additional explicit positioning requirements placed upon the user. Other biometric data sensors may also be used if desired. Various embodiments are disclosed.

34 Claims, 1 Drawing Sheet

DATA ENTRY SYSTEMS WITH BIOMETRIC DEVICES FOR SECURITY ACCESS CONTROL

BACKGROUND OF THE INVENTION

1. Field of the Invention

The present invention relates to the field of high security locks and related security devices.

2. Prior Art

High security locks and similar security devices of various kinds are well-known in the prior art. One class of such locks is keyboard or keypad operated locks wherein users of the locks are provided a code which, when entered into the keyboard, will operate the same. Such codes may be lock dependent, essentially serving as a combination for the lock, may be user dependent, essentially identifying the user to the lock system, or may be a combination of lock and user dependent. An example of the first type of lock are locks controlling access to parts of a secure facility where all authorized persons have the same entry code, whereas locks of the second type include those used as part of an automatic teller machine to enable function keys which allow one to withdraw money and conduct other transactions. Locks of the third type include locks controlling access to parts of a secure facility where each authorized person has a respective unique entry code that identifies that person to the system as well as provides the desired entry. In that regard, the words lock, locks and security devices as used herein are used in a general sense to denote a means for granting access to a place or enabling a function or an action which is otherwise disabled, such as the operation of a door latch, the withdrawal of funds in an automatic teller machine, or enabling any of various types of services in communication devices, computing devices, cash machines, point of sale terminals, etc., or alternatively, the disabling of something which is normally enabled, such as might be required to lock or disable something normally left unlocked or enabled.

In a conventional keyboard operated lock, the level of security attained is relatively low because the number to key assignments are fixed and ordered, with each key representing a specific number or numbers where such number or numbers are often permanently imprinted on or adjacent to the key, and the sequence of key depressions by a user are normally observable from either side of the user without substantial difficulty. To alleviate this problem and enhance the security of the overall system, keyboards and/or keypads are known wherein the keys are not given a predetermined and ordered and fixed 1-2-3 type sequence, but rather are given unique identifications for each use of the keypad, "which identifications are effectively scrambled before the next such use". In this manner, the physical key depression sequence observed by any outside observer during one operation of the system will have no meaning during the next operation of the system when the keys are identified differently, and reentry of the same physical key depression sequence by an interloper will result in the entry of a different code and thereby not result in a breach. Further, in such systems the key identifications appearing when the user is standing in front of the keyboard are highly directional, and not observable from the side. Thus, the body or head of the user blocks the key identifications from view by others, so that while the physical key depressions can be observed from the side, the key identifications associated therewith cannot similarly be determined.

Apparatus of the foregoing type provides a high level of security, as no information concerning the code for operating the lock, which may be personal to a specific user, is conveyed to an interloper watching the sequence of key depressions used to operate the security device. However, it is still possible with such systems that an interloper obtain the code through the use of force, threat, deceit, fraud, theft, or other malicious acts.

Biometric devices, including but not limited to optical biometric devices such as facial recognition, which includes but is not necessarily limited to, iris recognition, retina recognition, etc., may be used to enhance the security of a security system. Such biometric devices may provide an additional level of security since they require the presence of the person rather than simply the knowledge of a personal code that could have been obtained by way of force, threat, deceit, fraud or other malicious acts.

However, a drawback of biometric devices is that they typically require the position of a specific body part of a user to be consistently placed at a precise location for user recognition. For example, some biometric devices require a binocular type of device to position the retina and/or iris, or a mirror that requires the user to position themselves at a specific distance and in a specific inclination to a camera or reader for facial/iris recognition. In addition, these devices require that the user be aware of the positioning process and willingly comply in order to be recognized. Furthermore, they require time for the user to reach the proper position.

Thus, it would be desirable to provide a new security device that would enhance the level of security achieved individually by the hereinbefore described devices. In addition, it would be desirable for such a security system with a biometric device to provide a means by which information can be gathered from the user without inconveniencing the user.

DETAILED DESCRIPTION OF THE PREFERRED EMBODIMENTS

Figure 1:
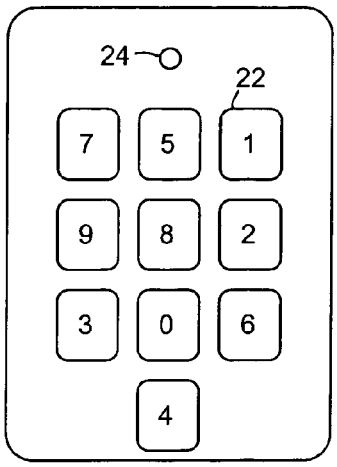
FIG. 1 is a face view of one exemplary embodiment of the present invention.

In the description to follow, various references are made to terms such as keys, keypads and key entry. These words may be used in the most general sense, and are to be interpreted in accordance with the context in which they are used. By way of example, in some instances the keys are like a key on a keyboard or keypad such as on a telephone in the sense that they incorporate switches that are activated on pressing of the keys. In accordance with the present invention, such keys would also incorporate some form of variable key identification. In other cases a key is merely a physical location, as in a speech activated system, though again in accordance with the present invention, each such location would incorporate some form of variable key identification. Such a key is then activated, not by depressing anything, but rather by speaking the key identification. Thus a keypad or keyboard is in general merely a group of keys arranged in some physical order for viewing and in some instances, for actuation. Key entry or actuation may be by actually pressing the key, or by any other means, such as speaking the key identification associated with pre-defined locations for speech recognition purposes. For convenience, devices that might be considered such a form of keypad or keyboard will simply be referred to hereafter as keypads.

The present invention takes advantage of the fact that in certain more advanced prior art security systems, the system is or can be configured so that the person using the security system must necessarily adequately physically align themselves with the system to be able to operate the same. By way of example, in prior art security systems wherein key identifications are scrambled, so that they vary from use to use, physical view restrictors make those identifications viewable only when the user's eyes are aligned with the system. Thus facial or eye alignment is a prerequisite for successful operation of the device. This is to be compared with prior art keypad systems wherein the keys have fixed identifications viewable from anywhere in the vicinity of the keypad. In this case, facial alignment is not necessary for operation of the keypad, and in fact, many people can operate a keypad without even looking at it.

Systems requiring facial or eye alignment to view scrambled key identifications include manually operable systems wherein keys are manually operated in accordance with a pre-assigned code or codes for that keypad or for that user, or a combination of both. Other such systems include systems wherein a spatial key position sequence is memorized and a code or codes are verbally input by the user and detected using speech recognition as the user reads a sequence of key identifications in the predetermined spatial sequence of key positions. Such systems, too, require the alignment of the person's face with the keypad during use, as otherwise the key identifications in the spatial sequence cannot be seen.

Because facial (including eye) alignment of the user of such security systems is necessary for the successful use of the system, the present invention incorporates one or more biometric readers in a most unobtrusive way to enhance the level of security obtained. As shall subsequently be described in greater detail, the biometric reader or readers may be incorporated in some embodiments of the invention by incorporation of one or more solid state cameras positioned to obtain the desired biometric data during use of the security system while the user of the system is appropriately aligned for seeing the key identifications. In particular, in security systems of the type in which the present invention will be incorporated, such systems normally require some initial activation by the user to initiate the display. Such activation is typically, but not necessarily, initiated by activation of a switch. If so, activation of the biometric reader preferably would not occur on activation of the switch, as such a switch normally can be activated without the desired facial alignment. However, upon starting of entry of the code or codes, facial alignment to within the restrictions of the system is substantially assured. In that regard, for systems that are sensitive to eye or head rotation, the view restrictor, an exemplary embodiment to be subsequently described in greater detail, may only allow viewing of all key identifications when the users head is in its ordinary, un-rotated condition. Accordingly, the biometric reader or readers may be initiated during the actual entry of the code or codes, preferably early in the entry of a multiple character code, as later character entries may be by way of memory once the scrambled assignment has been viewed for a few moments. Also actuation of the biometric device early in the code entry allows more time for data analysis, and data transmission for analysis at a central location in networked security systems.

Once the biometric reader has been initiated, a single reading, measurement or other data may be taken and processed for correlation with pre-stored images, measurements or other data for recognition purposes. Alternatively, multiple readings or measurements may be taken and averaged before processing for recognition purposes. As a further alternative implementation, multiple measurements may be individually processed and then averaged, if applicable, or the best fit or all fits may be used for identification purposes. Of course, other techniques may be used as desired.

Various types of biometric devices are well known in the art, such as devices for facial recognition. Facial recognition, as used herein, is used in the general sense, such as, by way of example, to denote recognition based on a facial image, a larger image such as one including the ears, a smaller image such as may be used for recognition of one or more selected features of a persons face or head, or for retina recognition, iris recognition or to measure eye separation. In that regard, facial recognition might be by way of, or include, other simple linear measurements rather than recognition of an image per se. Also, the image, feature and/or measurement used may be the same for all users, or may vary for each user based on individual distinctive features of the users.

Such biometric devices, in operation, generally comprise data or image acquisition, data or image analysis and comparison or correlation with prestored information for recognition purposes. The present invention, of course, is directed principally to alignment for data or image acquisition purposes, as the data or image analysis, storage and comparison or correlation with predetermined information, etc. is well known, regularly improved and steadily reduced in cost by the declining costs and increased capabilities of digital data processing equipment, particularly microprocessor-based equipment.

In certain embodiments of the present invention, it may be desirable to use multiple cameras for recognition of different features or characteristics of each user of the security system, to compensate for differences in the exact positioning of the user, or for other purposes. By way of example, two cameras separated horizontally by an average adult eye separation might provide an image of each eye for iris recognition or retina recognition, or both at the same time, also providing image data for determination of eyeball separation with a grossly reduced sensitivity to the exact distance between the cameras and the user's eyes. A typical iris recognition system is an example of a system wherein assuring the head of the user is not rotated is preferable or necessary for proper operation.

The present invention has various advantages over the use of a scrambled keypad alone or a biometric device alone. In particular, a scrambled keypad is as secure as the code itself, and once the code is known to an unauthorized person, unauthorized penetration of the security system is a simple matter. Biometric devices, on the other hand, while overcoming this limitation, have the disadvantage that they require the user to not only be aware that the process is occurring, but to also voluntarily properly position themselves before the system acquires and begins to process the relevant information. Thus, while the present invention is quite unobtrusive, the use of biometric devices alone is in general quite intrusive. For instance, when using the present invention, if the reading of the biometric device does not provide the degree of match or correlation with prestored data that is desired, a simple "please reenter your code" instruction may be issued through digitally generated speech, a display, an indicator light, or otherwise. When such an instruction is issued, the normal human response is to reenter the code with greater care, and thus typically with even better facial alignment for biometric device data acquisition purposes, all of which is still very non-intrusive.

Another advantage of the present invention is that the biometric data taken during failed attempts to operate the security system may be retained for later examination, or even immediately brought to someone's attention for appropriate action. This will be discussed further herein.

The word "recognition" has been used herein in a manner which may imply a positive sense. By way of example, one might use some form of recognition such as facial recognition, such as iris recognition or retina recognition to identify the user of the security system as one of the authorized users in the biometric database to within the required degree of certainty, and assuming that user enters the code associated with the user so identified, the requirements of the security system will be satisfied. Recognition, however, may also be used herein in a negative sense. By way of example, the security code entered by the user might specifically identify an authorized user or one of a small group of authorized users, in which case the biometric data may be used to reject that identification as not being adequately verifiable. In such an embodiment, the biometric data may be processed as required during data entry, but the ultimate comparison or correlation would wait for code entry to be completed, as only comparison or correlation with the data for the individual or small group of individuals identified by the code itself need be made. That ultimate comparison or correlation, therefore, is to reject users that cannot be verified within acceptable limits as being who they purport to be.

Stated differently, processing of the security code prior to use of the biometric data permits the system to operate only to verify that the biometric data matches that of the user whose code was entered. This is a far simpler task than to do a search through an entire biometric database for a match to the input biometric data. Thus, the use of the combination of a code entry and biometric data in this manner dramatically reduces the processing power and processing time required by the system and potentially allows significantly cheaper and simpler hardware implementations.

Now referring to FIG. 1, an exemplary keypad, generally indicated by the numeral 20, in accordance with an exemplary embodiment of the present invention may be seen. The keypad 20 in this embodiment comprises 10 keys 22, arranged much like a telephone keypad. The scrambled numbering shown illustrates an exemplary scrambling of key identifications, preferably made viewable only by the user, and then only when the user's eyes, and thus face, are appropriately aligned horizontally and vertically with respect to and properly spaced from the keypad.

Also visible in FIG. 1 is a small solid-state camera 24, positioned to get a repeatable view of the user's face when the user is aligned for viewing of the randomized key identifications. The keypad itself might have a start switch or be activated on depression of any of the switches on the keypad or be activated by the sensing of the proximity of an individual or a hand or by other means, with the camera 24 preferably being activated for its recognition function as the user begins entry of the code. The camera 24, of course, should be positioned to get a view of the user's features to be recognized without obstruction of the user's hand. Accordingly, FIG. 1 should be considered schematic only, as the camera might be positioned somewhat higher to better avoid the possibility of such obstruction.

Figure 2:
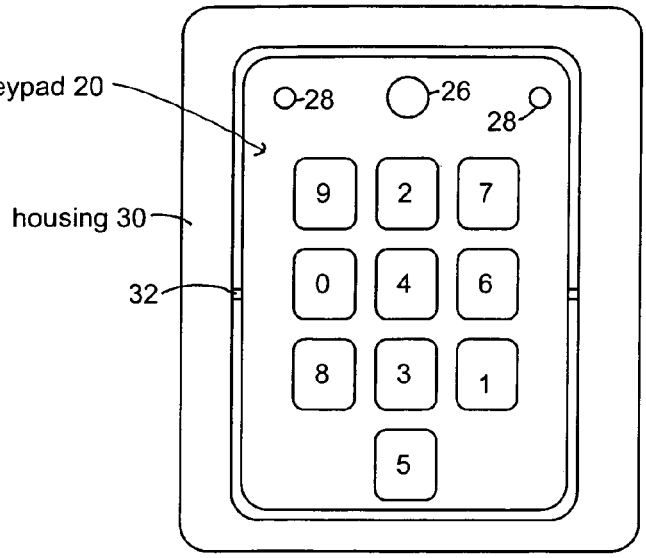
FIG. 2 is a face view of another exemplary embodiment of the present invention.

FIG. 2 shows an embodiment similar to FIG. 1, though with certain variations. While the scrambled key identification is again shown as a scrambling of the numbers 0 through 9, other characters such as alpha characters, or even images or outlines of objects selected for ease in distinguishing therebetween using speech recognition techniques could be scrambled and displayed. In any event, the embodiment illustrated in FIG. 2 is intended for speech recognition of the various characters displayed as spoken by a user of the security system in accordance with a pre-memorized spatial key sequence. For this purpose, a microphone 26 is provided. In this embodiment, two cameras 28 separated by an average adult eye separation provide for retina recognition, iris recognition, eyeball separation measurement, etc. Also in this embodiment, the keypad, generally indicated by the numeral 20, is supported on a frame or housing 30, and is rotatable about a horizontal axis 32 to accommodate users of a different height. This may be an important convenience, as the keypad should be relatively easily viewed by persons under 5 feet tall to persons approaching 7 feet tall, and the characters preferably are quite limited in viewing angles, preferably both in a horizontal and in a vertical direction. In that regard, while security devices are usually armored, the keypad itself need not be, as access to the internal workings of the keypad or to the electrical connections to the housing doesn't help facilitate unauthorized operation of the device. As a further level of security, an angle sensor could be incorporated to sense the angle of the keypad during use as an indication of how tall the user is. Such an indication may have limits in accuracy (a woman in high heals one day, and not another day), but could provide a rough indication for elimination of obvious mismatches.

Figure 4:
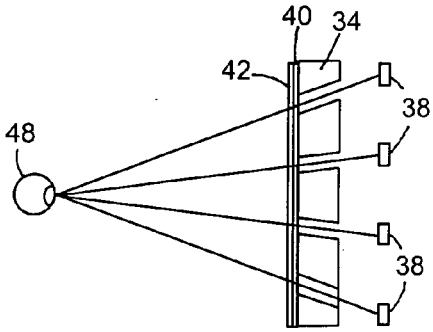
FIG. 4 is a diagram illustrating a vertical cross section of the exemplary mechanical view restrictor of FIG. 3.
Figure 3:
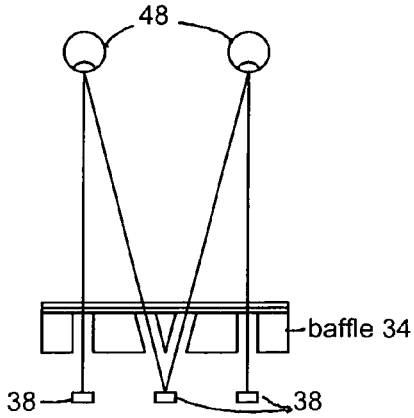
FIG. 3 is a diagram illustrating a horizontal cross section of one exemplary mechanical view restrictor that may be used with the present invention.

The view restrictor or restrictors may take various forms ranging from mechanical baffles to more sophisticated lensing or lens arrays, holographic displays, etc. An exemplary baffle 34 is schematically shown in FIGS. 3 and 4, respectively. FIG. 3 is a view taken in a horizontal plane showing a person's two eyes 48 viewing individual character displays 38 behind the restrictor, and FIG. 4 is a similar view taken in a vertical plane. Note that in FIG. 3, the key identifications from the center to the left are viewable by one eye and the key identifications from the center to the right are viewable by the other eye. Consequently the user cannot see all key identifications at the same time unless the user's two eyes 48 are aligned vertically (both eyes in the same horizontal plane, i.e., head is not rotated), as otherwise the vertical restriction of FIG. 4 will not allow both eyes to see all key identifications at the same time. Such a view restrictor can also generally function properly for persons that are effectively blind in one eye, as such users will automatically rock their head back and forth to see all key identifications, rather than moving their entire body. Therefore, since systems such as iris recognition systems are not sensitive to eye rotation so long as the angle of rotation is the same each time, repeatable data may be obtained as long as the image acquisition is triggered when such a user is always responding to a key identification at the same side of the keypad.

Such a restrictor could simply be a molded black plastic piece with a matt black finish. The keypad could be comprised of seven segment light emitting diode displays 38 behind the view restrictor 34 with a clear plastic plate 40 and a plastic membrane keypad 42 thereover. This, of course, is exemplary only, as many other keypad structures, including but not limited to those having lighted key identifications thereunder, are well known in the prior art. Also with respect to the view restrictor, as stated before, other types of view restrictors may also be used, including mechanical restrictors having an increased number of baffles for further view restriction. Also, while more sophisticated view restrictors may be used, in at least many instances, relatively simple mechanical view restrictors should be adequate to cause the user to sufficiently accurately locate himself with respect to the keypad, and thus with respect to the camera, for most recognition technologies. In that regard, the view restrictor or restrictors, whatever may be used, need only be as good or effective as required for the proper operation of the recognition technology being used, as excessive alignment requirements again become intrusive.

Even if the view restrictor allows one eye to see all the keys, there is a natural tendency to want to see stereoscopically, so if the only way to get a clean stereo view is to have both eyes in the same horizontal plane, that would tend to encourage alignment as well. A restrictor is still beneficial, however, to prevent one from viewing the keypad from the side.

The systems hereinbefore specifically disclosed have included optical systems using one or more solid state cameras for image or data acquisition. Such optical systems may operate on visible light, or invisible light such as infrared light. Also other biometric sensors requiring some facial alignment may be used instead of or in addition to cameras, such as, by way of one example, a sonar type of sensor. Such a sensor might comprise a small phased array of sound transmitter/receivers invisibly incorporated on the face panel of the keypad and used to sweep a users face for "image" or data acquisition purposes. Operating on a frequency above the audio range would make the biometric device operation undetectable, yet provide information in the third dimension (nose length, the depth of the eyes) or image data (cheek and forehead contours, etc.) that would be particularly difficult to somehow synthesize.

Figure 5:
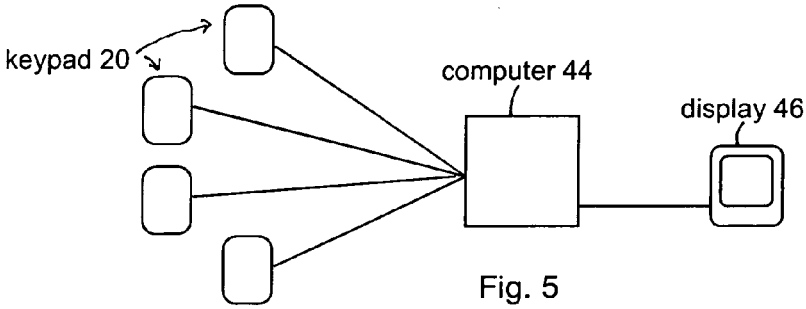
FIG. 5 is a diagram illustrating the use of the present invention as a part of a security network.

The present invention may be used as part of a standalone system though is more commonly and efficiently used as part of a security system network (see FIG. 5), wherein a plurality of keypads in accordance with the present invention controlling access (locks), enabling operation of equipment, etc., are coupled through a network such as a local area network to a computer 44. The computer, located in a secure location, stores predetermined data, processes images or other data received from each keypad, compares or correlates that data with prestored data, and provides information back to the keypad accepting or rejecting the attempted user identification. The computer also controls the enabling of whatever is controlled by the security system, frequently, but not always, through separate communication lines, not shown. Since the present invention may incorporate one or more cameras and image data storage and transmission capabilities, the system may include the ability to transmit and permanently store a facial image of the user, either each time the system is used, or alternatively, at least each time an attempted user identification is rejected. That image may be displayed on a display 46 in real-time or in a later viewing.

In the claims that follow, the words data and digital data are used in the general sense to include, but not be limited to, two dimensional image data, visible or not, three dimensional image and/or contour data, and non-image data such as linear dimensions (eye to eye, length of nose, etc.), color (such as color of hair), or other characteristics or parameters.

In the foregoing specification, the invention has been described with reference to specific embodiments thereof. It will be evident however, that various modifications and changes may be made thereto without departing from the broader spirit and scope of the invention. The specification and drawings are, accordingly, to be regarded in an illustrative rather than a restrictive sense.

What is claimed is:

1. A security device comprising:

a keypad/display having a plurality of code symbol display positions, each for displaying any one of a plurality of code symbols, the code symbols being restricted so as to be viewable by a keypad/display user only when the user's face is located in a particular position relative to the keypad/display, the keypad/display changing the display position of code symbols on each operation of to keypad/display; and a biometric device associated with the keypad/display for acquiring data from at least a portion of said user's face situated in said particular region and performing biometric recognition of said user using said data;

the biometric device being activated in response to or in conjunction with the initiation of the entry of a code responsive to the code symbols displayed.

2. The security device of claim 1 wherein the keypad/display comprises a plurality of manually operable keys for entry of a code, each key being associated with a respective code symbol display position.

3. The security device of claim 1 wherein the keypad/display includes a microphone and associated speech recognition for entry of a code by recognizing a spoken sequence of code symbols corresponding to the symbols then being displayed in a predetermined spatial sequence of code symbol display positions.

4. The security device of claim 1, wherein said biometric device performs facial recognition of said user.

5. The security device of claim 1, wherein said biometric device performs retina recognition of said user.

6. The security device of claim 1, wherein said biometric device performs iris recognition of said user.

7. The security device of claim 1, wherein said biometric device comprises a solid state camera.

8. The security device of claim 1 wherein the keypad/display is rotatable about a horizontal axis to allow persons of different height to conveniently view the code symbols.

9. The security device of claim 8 further comprising a sensor sensing the angle of the keypad/display about a horizontal axis to provide an additional level of user recognition.

10. A method of operating a security system comprising:

providing a keypad/display having a plurality of code symbol display positions, each for displaying any one of a plurality of code symbols, the code symbols being restricted so as to be viewable by a keypad/display user only when the user's face is located in a particular position relative to the keypad/display;

providing an biometric device associated with the keypad/display for acquiring data from a portion of the user's face situated in said particular region and performing biometric recognition of said user using said data;

on each operation of the keypad/display, changing the code symbols displayed at the code symbol display positions;

sensing the entry of a code by the user, and during the entry of the code, initiating optical biometric device to obtain data from said user's face;

comparing the code entered and the data taken to predetermined criteria for recognition of the user.

11. The method of claim 10 wherein the entry of a code is sensed by sensing the actuation of manually operable keys on the keypad/display, each key being associated with a respective code symbol display position.

12. The method of claim 10 wherein the keypad/display includes a microphone, and wherein entry of a code is sensed by sensing the speaking of a code sequence by a user of code symbols corresponding to the symbols ten being displayed in a predetermined spatial sequence of code symbol display positions and identifying the code spoken using speech recognition techniques.

13. The method of claim 10 wherein the code entered is compared with predetermined criteria for recognition of the user to determine the predetermined criteria to which the data is then compared for recognition of the user.

14. The method of claim 10 wherein comparing the data taken to predetermined criteria for recognition of the user is done using facial recognition techniques.

15. The method of claim 10 wherein comparing the data taken to predetermined criteria for recognition of the user is done using retinal recognition techniques.

16. The method of claim 10 wherein comparing the data taken to predetermined criteria for recognition of the user is done using iris recognition techniques.

17. A method comprising:

varying spatial positions of a plurality of code symbols on a keypad/display, the code symbols being viewable only from a limited viewing position;

receiving an access code entered by a user using said keypad/display;

comparing said access code to an authorized access code;

acquiring digital data from a biometric sensor sensing biometric data of a persons face in the limited viewing position in response to said user operating said keypad/display;

comparing said user digital data to an authorized user digital data; and performing a specified function in response to said access code matching said authorized access code and said user digital data matching said authorized user digital data.

18. The method of claim 17, wherein said authorized access code is stored in a memory local to said keypad/display.

19. The method of claim 17, wherein said authorized access code is stored in a remote memory accessible by way of a network.

20. The method of claim 17, wherein said authorized digital data is stored in a memory local to said keypad/display.

21. The method of claim 17, wherein said authorized digital data is stored in a remote memory accessible by way of a network.

22. A security device, comprising:

a keypad/display to visually display a plurality of code symbols respectively in a plurality of spatial positions for viewing from a restricted position and to enable a user to enter an access code;

a camera to obtain digital data relating to the user; and one or more processors to cause:

a varying of the spatial positions of said code symbols on said keypad/display;

the receipt of an access code, and initiation of the camera to obtain digital data relating to the user during receipt of the access code;

a comparison of said access code with an authorized access code;

a comparison of the digital data with an authorized user digital data; and a performance of a specified function in response to the access code matching the authorized access code for an authorized user and the user digital data matching the authorized user digital data.

23. A security device comprising:

a keypad/display having a plurality of code symbol display positions, each for displaying any one of a plurality of code symbols, the code symbols being restricted so as to be viewable by a keypad/display user only when the user's face is located in a particular position relative to the keypad/display, the keypad/display changing the display position of code symbols on each operation of the keypad/display; and a biometric device associated with the keypad/display for acquiring data from at least a portion of said user's face situated in said particular region and performing biometric recognition of said user using said data;

the biometric device being activated in response to or in conjunction with the initiation of the entry of a code responsive to the code symbols displayed;

the keypad/display includes a microphone and associated speech recognition for entry of a code by recognizing a spoken sequence of code symbols corresponding to the symbols then being displayed in a predetermined spatial sequence of code symbol display positions.

24. The security device of claim 23, wherein said biometric device performs facial recognition of said user.

25. The security device of claim 23, wherein said biometric device performs retina recognition of said user.

26. The security device of claim 23, wherein said biometric device performs iris recognition of said user.

27. The security device of claim 23, wherein said biometric device comprises a solid state camera.

28. The security device of claim 23 wherein the keypad/display is rotatable about a horizontal axis to allow persons of different height to conveniently view the code symbols.

29. The security device of claim 28 further comprising a sensor sensing the angle of the keypad/display about a horizontal axis to provide an additional level of user recognition.

30. A method of operating a security system comprising:

providing a keypad/display having a plurality of code symbol display positions, each for displaying any one of a plurality of code symbols, the code symbols being restricted so as to be viewable by a keypad/display user only when the user's face is located in a particular position relative to the keypad/display;

providing an biometric device associated with the keypad/display for acquiring data from a portion of the user's face situated in said particular region and performing biometric recognition of said user using said data;

on each operation of the keypad/display, changing the code symbols displayed at the code symbol display positions;

sensing the entry of a code by the user by sensing the speaking of a code sequence by a user of code symbols corresponding to the symbols then being displayed in a predetermined spatial sequence of code symbol display positions and identifying the code spoken using speech recognition techniques, and during the entry of the code, initiating optical biometric device to obtain data from said user's face;

comparing the code entered and the data taken to predetermined criteria for recognition of the user.

31. The method of claim 30 wherein the code entered is compared with predetermined criteria for recognition of the user to determine the predetermined criteria to which the data is then compared for recognition of the user.

32. The method of claim 30 wherein comparing the data taken to predetermined criteria for recognition of the user is done using facial recognition techniques.

33. The method of claim 30 wherein comparing the data taken to predetermined criteria for recognition of the user is done using retinal recognition techniques.

34. The method of claim 30 wherein comparing the data taken to predetermined criteria for recognition of the user is done using iris recognition techniques.

* * * * *